US009481979B2

(12) United States Patent
Hiraoka et al.

(10) Patent No.: US 9,481,979 B2
(45) Date of Patent: Nov. 1, 2016

(54) WORKING MACHINE

(71) Applicant: KOBELCO CONSTRUCTION MACHINERY CO., LTD., Hiroshima-shi (JP)

(72) Inventors: Yukio Hiraoka, Hiroshima (JP); Keiji Yamamoto, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/520,462

(22) Filed: Oct. 22, 2014

(65) Prior Publication Data

US 2015/0115661 A1 Apr. 30, 2015

(30) Foreign Application Priority Data

Oct. 29, 2013 (JP) ..... 2013-224465

(51) Int. Cl.

| | |
|---|---|
| ***E02F 9/00*** | (2006.01) |
| ***E02F 9/08*** | (2006.01) |
| ***E02F 9/20*** | (2006.01) |
| ***E02F 3/32*** | (2006.01) |

(Continued)

(52) U.S. Cl.

CPC ..... *E02F 9/0808* (2013.01); *E02F 3/325* (2013.01); *E02F 9/16* (2013.01); *E02F 9/2004* (2013.01); *E02F 9/2275* (2013.01)

(58) Field of Classification Search

CPC ..... E02F 8/0808; E02F 3/3325; E02F 9/16; E02F 9/2004; E02F 9/2275

USPC ..... 296/190.01, 190.08, 37.8; 180/315, 180/326, 89.12

See application file for complete search history.

(56) References Cited

U.S. PATENT DOCUMENTS

| | | | | |
|---|---|---|---|---|
| 8,646,826 | B2 * | 2/2014 | Wihinen | B60K 35/00 180/89.12 |
| 8,978,812 | B2 * | 3/2015 | Kimura | E02F 9/2004 180/324 |
| 2012/0104798 | A1 | 5/2012 | Takeda et al. | |

FOREIGN PATENT DOCUMENTS

| | | |
|---|---|---|
| JP | 11-181835 | 7/1999 |
| JP | 2002-146838 A | 5/2002 |

(Continued)

OTHER PUBLICATIONS

Extended European Search Report issued Mar. 20, 2015 in Patent Application No. 14190408.6.

(Continued)

*Primary Examiner* — Joseph D Pape

(74) *Attorney, Agent, or Firm* — Oblon, McClelland, Maier & Neustadt, L.L.P.

(57) ABSTRACT

Provided is a working machine including a console box restrained from wobble. The working machine includes a machine body having an operator's seat and a console box at a side of the operator's seat. The console box includes a box body and a box cover covering the box body. The box cover internally includes a first cover half installed on the box body with first fitting portions and a second cover half internally including second fitting portions fitted with the respective first fitting portions. The second cover half abuts on the first cover half and coupled to the first cover half by respective interfittings of the first and second fitting portions. The box body includes a support portion making contact with an inner surface of the second cover half to support the second cover half.

6 Claims, 7 Drawing Sheets

(51) Int. Cl.
*E02F 9/16* (2006.01)
*E02F 9/22* (2006.01)

(56) References Cited

FOREIGN PATENT DOCUMENTS

| | | | |
|---|---|---|---|
| JP | 2003-90063 | A | 3/2003 |
| JP | 2003-253703 | A | 9/2003 |
| JP | 2008-74128 | A | 4/2008 |
| JP | 2012-92611 | | 5/2012 |

OTHER PUBLICATIONS

Notification of Reasons for Refusal issued Sep. 1, 2015 in Japanese Patent Application No. 2013-224465 (with English language machine translation).

* cited by examiner

WORKING MACHINE

BACKGROUND OF THE INVENTION

1. Field of the Invention

The present invention relates to a working machine, such as a hydraulic excavator, equipped with an operator's scat and a console box disposed at the side thereof.

2. Description of the Background Art

As a working machine such as a hydraulic excavator, there has been known one type equipped with an operator's seat, and console boxes provided on right and left sides of the operator's seat respectively, each console box including an operation lever. In many cases, the console box which is one of the right and left console boxes and located on the side of an entrance way for the operator's seat is configured to be able to be upturned rearward so as not to be an obstacle to an operator getting in or out of the working machine, for example, as disclosed in JP 2012-92611 A (Patent Literature 1). As the console box is so close to an operator who manipulates the operation levers as to be highly visible, not only strength but also the aesthetic quality of appearance is extremely important factor for the console box.

In this connection, JP 11-181835 A (Patent Literature 2) discloses an invention relating to a control box designed to improve aesthetic quality of appearance thereof. The control box comprises a box cover including: a control-box body having a pair of right and left box halves; and a console box attached to an upper portion of the control box body. In the box cover, the right and left box halves are integrally coupled to each other by a threaded rod for assembly to thus form the control box body, to which the console box is fastened by a screw. The box cover described in the Parent Literature 2, thus, has many components and requires a lot of process times for assembling it. Moreover, the box cover, which leaves a fastened region exposed outward, is still improvable in aesthetic quality of appearance.

Meanwhile, under development is a so-called "fitting-type box cover, which is divided into two right and left cover halves capable of abutment on each other to be intercoupled. This intercoupling is achieved by providing a pair of groups of fitting portions inside each of the cover halves at several positions and fitting the fitting portions in one group with the fitting portions in the other group, respectively, so as to prevent fastened portions from exposure.

According to the fitting-type box cover, a first one of the cover halves, whose inside is opened before the mutual coupling of the cover halves, can be fastened to a bracket or the like housed in the console box, thus allowed to be securely fixed while allowing the fastening portion to be concealed inside the console box so as to prevent it from exposure; however, the other cover half, namely, a second cover half, is not fixed except by the attachment through several fitting portions to the first cover half previously fixed in the above manner, thus having a risk of being wobbled by a strong force exerted thereon. The wobble may be suppressed by increase in the number of the fitting portions, which increase, however, involves difficulty in molding of the cover halves and increase in component cost and molding cost. Moreover, the increase in the number involves an increase in force required for fitting, causing difficulty also in an assembling work.

SUMMARY OF THE INVENTION

It is an object of the present invention to provide a working machine including a console box prevented from wobble without excessive increase in the number of fitting regions while possessing a fine appearance.

Provided by the present invention is a working machine comprising: a machine body including an operator's seat; and a console box disposed at a side of the operator's seat. The console box includes a box body supported by the machine body, and a box cover covering the box body while being supported by the box body. The box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to abut on the first cover half involving respective fittings of the first and second fitting portions with each other to be thereby coupled to the first cover half. The box body includes a support portion which makes contact with an inner surface of the second cover half to thereby support the second cover half in cooperation with the first and second fitting portions.

DESCRIPTION OF THE PREFERRED EMBODIMENTS

With reference to the drawings, there will be specifically described below an embodiment according to the present invention. It should be noted that the following description is essentially made by way of illustration only, and is not intended to limit the present invention.

Figure 1:
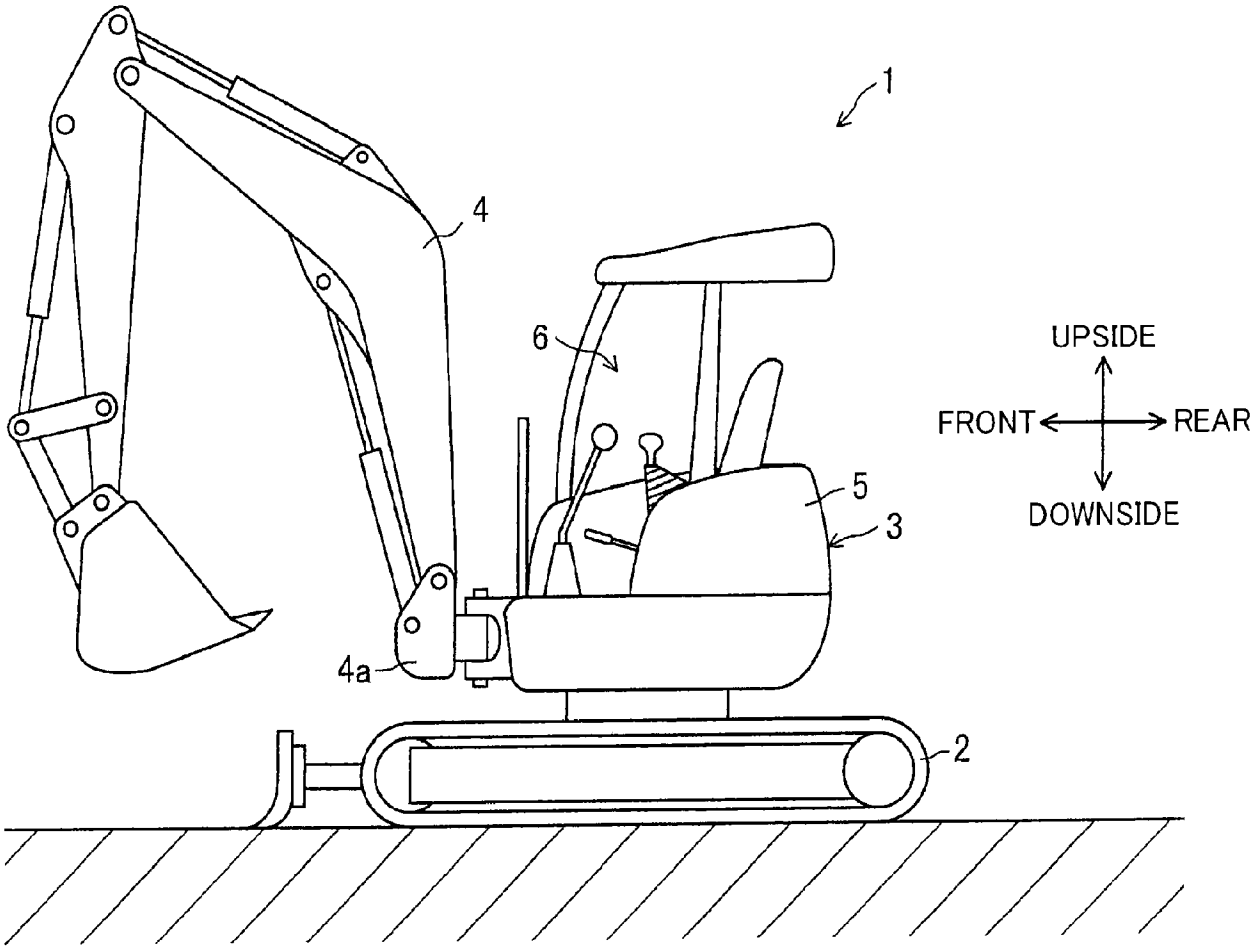
FIG. 1 is a schematic side view showing a hydraulic excavator according to one embodiment of the present invention.
Figure 2:
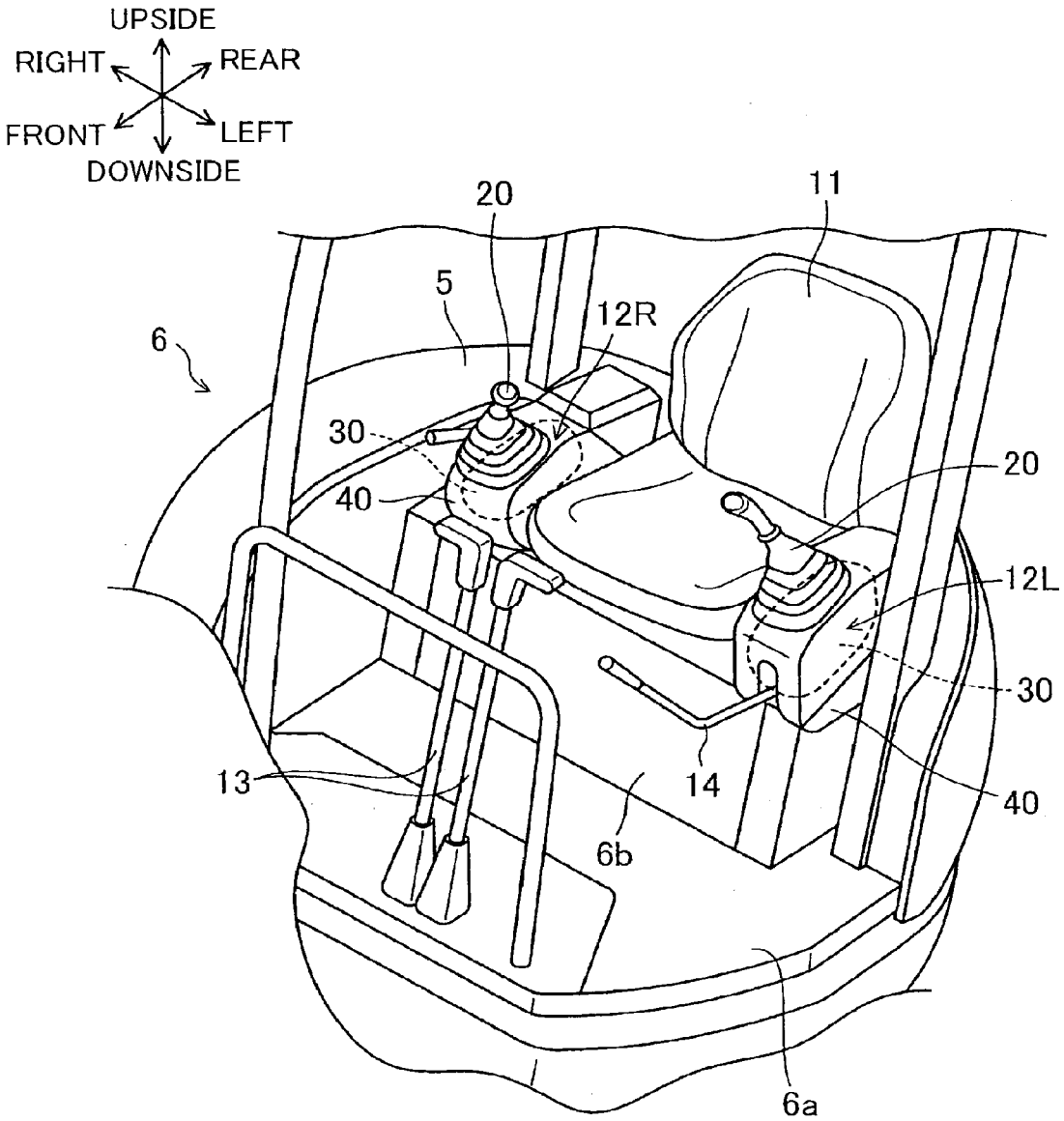
FIG. 2 is a perspective view showing an operator's space of the hydraulic excavator.

FIG. 1 shows a hydraulic excavator 1 which is one example of a working machine to which the present invention is applied. The hydraulic excavator 1 is a minimal tail swing radius-type small-size model which comprises a crawler-type lower travelling body 2, and a machine body 3 slewably mounted on the lower travelling body 2. Directions, such as front, rear, right and left, used in the following description are defined based on the machine body 3.

The machine body 3 includes an attachment 4, a machine room 5, an operator's space 6 and a floor member 7.

The attachment 4, which is a working device configured to make a working operation according to operator's manipulation, is located at a front end of the machine body 3. The attachment 4 includes a boom, an arm and a bucket, whose respective movements thereof are hydraulically controlled. The attachment 4 according to this embodiment is supported by a swing bracket 4*a*, being allowed to be swung integrally with the swing bracket 4*a* in a right-left direction relatively to the other part of the machine body 3.

The machine room 5 makes up a region of the machine body 3, the region continuously including a right part and rear part thereof. The machine room 5 accommodates an engine and others therein.

The operator's space 6 is an opened space making up a front-right region of the machine body 3. As components provided in the operator's space 6, the hydraulic excavator according to this embodiment includes a seat stand 6*b*, an operator's seat 11, a right console box 12R, a left console box 12L and a traveling lever 13.

The floor member 7 has an upper surface which serves as a floor surface 6*a* spreading in a front region of the operator's space 6. The seat stand 6*b* is disposed in a rear region of the operator's space 6, and the operator's seat 11 is disposed on an upper surface of the seat stand 6*b*. The right console box 12R and the left console box 12L are disposed on respective right and left sides of the operator's seat 11.

Each of the right and left console boxes 12R, 12L includes an operation lever 20, a box body 30 and a box cover 40. The operation lever 20, which constitutes an operation device for operating the attachment 4, is disposed so as to protrude obliquely upwardly and forwardly beyond a front region of an upper portion of the box cover 40. The box body 30 is accommodated in the box cover 40, entirely covered with the box cover 40.

The hydraulic excavator according to this embodiment has an entrance way for the operator's seat 11 on the left side of the operator's seat 11. Hence, the left console box 12L is designed to be capable of being upturned rearward. Specifically, the left console box 12L includes an upturn lever 14, and a upturn manipulation applied to the upturn lever 14 so as to lift up a distal end portion of the upturn lever 14 causes a front end of the left console box 12L to be lifted up and rotationally moved rearward. The left console box 12L thereby stands up, opening the entrance way to facilitate getting in or out of the hydraulic excavator.

Figure 3:
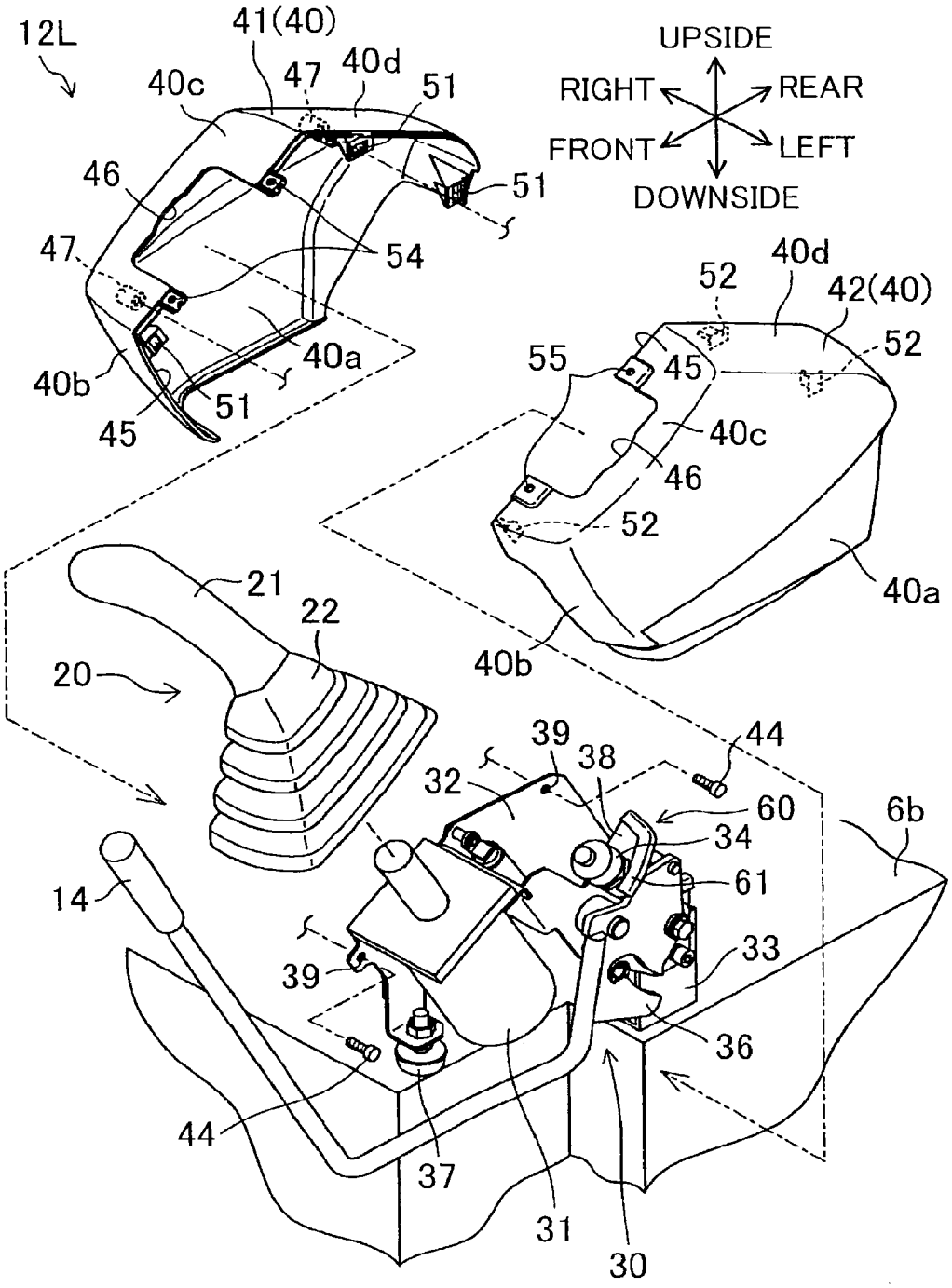
FIG. 3 is an exploded perspective view showing a left console box in the hydraulic excavator.
Figure 4:
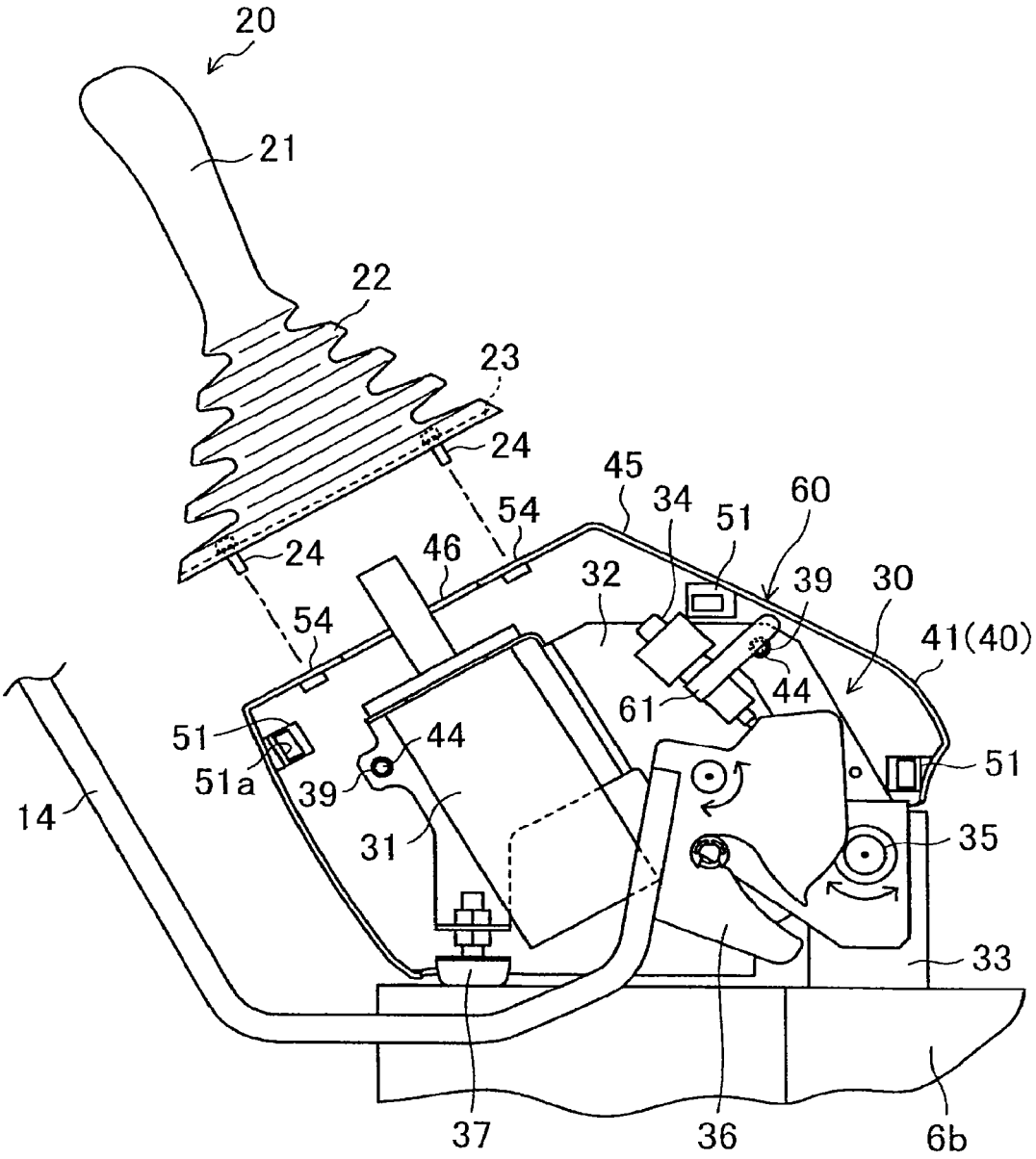
FIG. 4 is a side view showing the left console box with no attachment of a second cover half to a first cover half.

FIGS. 3 and 4 show a structure of the left console box 12L.

The box body 30 of the left console box 12L includes: a pilot valve 31 which controls a hydraulic pressure according to manipulation applied to the operation lever 20; a frame structure 32; a bracket 33; and a limit switch 34. The bracket 33 is fixed to an upper surface of the seat stand 6*b*, while rotationally movably supporting a rear end of the frame structure 32 through a shaft 35 extending in the right-left direction.

The frame structure 32 is a structure based on the assembly of a plurality of metal components. The pilot valve 31 is mounted on a front end of the frame structure 32. The frame structure 32 is attached with a support plate 36. The support plate 36 is rotationally movably mounted on a left lateral portion of the frame structure 32 while integrally joined to a base end of the upturn lever 14. The pilot valve 31 is connected with a plurality of non-graphically-shown hydraulic pressure hoses, which extending from the machine room 5 to be connected to a lower portion of the pilot valve 31. The upturn manipulation applied to the upturn lever 14 causes the support plate 36 to make a rotational movement. In conjunction with the movement, the entire frame structure 32 is rotationally moved about the shaft 35, thereby reaching an upturn position where the frame structure 32 has been upturned.

The frame structure 32 is provided with an abutment portion 37 having elasticity, at a bottom of the front end of the frame structure. The abutment portion 37 is configured to abut against the upper surface of the seat stand 6*b* when the frame structure 32 has been returned from the upturn position to a manipulation position shown in FIGS. 3 and 4 to thereby restrict the frame structure 32 from the rotational movement and support the front end of the frame structure 32. The abutment portion 37 thus functions as a stopper.

The limit switch 34 is provided so as to be capable of touching the support plate 36, configured to detect whether or not the upturn lever 14 is being in the manipulation position, based on the touch. Specifically, the frame structure 32 is provided with a support flange 38 protruding leftward in an upper region of the rear end of the frame structure 32, the support flange 38 supporting the limit switch 34 at a position which enables the limit switch to touch the support plate 36.

The box cover 40 is shaped as a box having an opened bottom, configured to be installed on the frame structure 32 to cover the frame structure 32 at the upper side of the frame structure 32. The box cover 40 includes a first cover half 41 and a second cover half 42, which are configured to abut on each other in the right and left direction to be intercoupled. The first cover half 41 and the second cover half 42, each of which is a resin molded product, have respective shapes which are bilaterally symmetric, the shapes being obtained by vertical division of the box cover 40 into two halves.

Each of the first cover half 41 and the second cover half 42 has a sidewall portion 40*a*, a half-front-wall portion 40*b*, a half-upper-wall front portion 40*c* and a half-upper-wall rear portion 40*d*. Under the installation on the frame structure 32, the box cover 40 is oriented such that: the sidewall portions 40*a* are faced rightward and leftward respectively; the half-front-wall portions 40*b* are faced forward, the half-upper-wall front portions 40*c* are directed obliquely frontward and upward; and the half-upper-wall rear portions 40*d* are faced obliquely rearward and upward.

In each of the first and second cover halves 41, 42, one of opposite lateral ends of each of the half front-wall portions 40*b*, the half-upper-wall front portion 40*c* and the half-upper-wall rear portion 40*d* are continuously joined to the common sidewall portion 40*a*. The other respective lateral ends of the half front-wall portion 40*b*, the half-upper-wall front portion 40*c* and the half-upper-wall rear portion 40*d* are continuously joined with each other to form a joining end 45. The first and second cover halves 41, 42 are coupled to each other with the abutment of the joining ends 45 on each other.

Each of the half-upper-wall front portions 40*c* is provided with a cutout 46. The cutouts 46 form a coupling opening which allows an upper portion of the pilot valve 31 to be exposed to the outside therethrough when the first and second cover halves 41, 42 abut on each other.

The first cover half 41 is installed on a right lateral portion of the frame structure 32. The sidewall portion 40*a* of the first cover half 41 has an inner surface, which is formed with a plurality of (in this embodiment, two) bosses 47. In correspondence to an arrangement of the bosses 47, the frame structure 32 is formed with a plurality of bolt holes 39. The bolt holes 39 allow a plurality of bolts 44 to be inserted into the bolt holes 39, respectively, from a left side thereof and screwed into the bosses 47, respectively, thereby allowing the first cover half 41 to be rigidly fixed to the frame structure 32. The bosses 47 and the bolt holes 39, located inside the box cover 40, cannot impair the aesthetic quality of appearance of the left console box 12L.

The second cover half 42 is attached to the first cover half 41 by means of the following structure.

The first cover half 41 has a plurality of (in this embodiment, three) first fitting portions 51, which are spaced along an edge of the joining end 45 of the half front-wall portion 40*b*, the half upper-wall front portion 40*c* and the half-upper-wall rear portion 40*d*. In this embodiment, the first fitting portions 51 are provided in an upper region of the half front-wall portion 40*b*, and in front and rear regions of the half-upper-wall rear portion 40*d*, respectively. Each of the first fitting portions 51 is formed with a rectangular-shaped fitting hole 51*a* oriented in the right-left direction, and located inside the first cover half 41.

Figure 5:
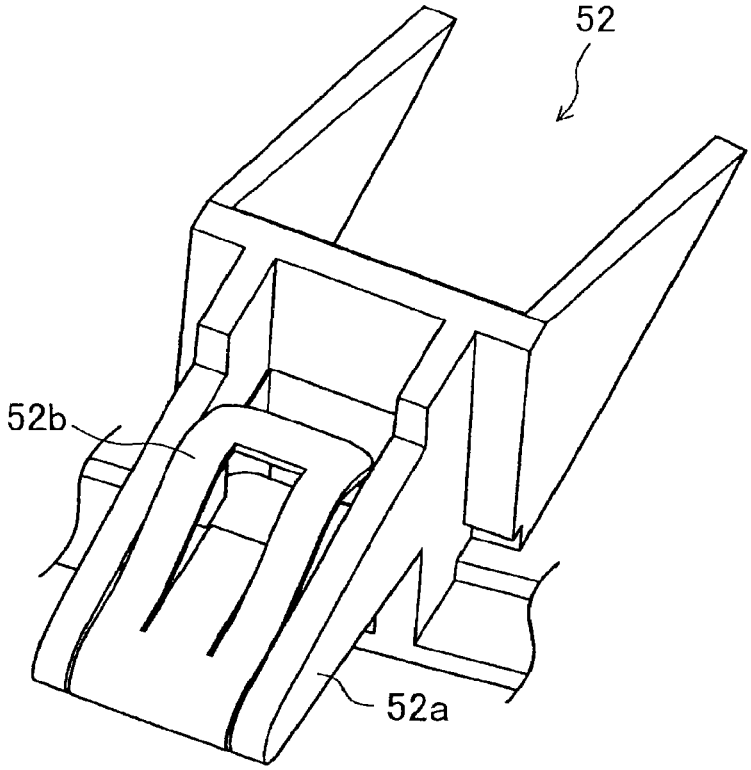
FIG. 5 is a perspective view showing an enlarged second fitting portion of the second cover half.

The second cover half 42 has a plurality of second fitting portions 52 arranged in correspondence to the arrangement of the first fitting portions 51. As shown in FIG. 5, the second fitting portions 52 have respective pawl portions 52*a* protruding rightward to be insertable into the fitting holes 51*a*, respectively. Each of the pawl portions 52*a* includes a snap lock segment 52*b* elastically deflectable. The snap block 52*b* is configured to be elastically deflected involved by the insertion of the pawl portion 52*a* into the fitting hole 51*a* and then elastically returned after the pawl portion 52*a* has passed through the fitting hole 51*a* to thereby prevent the pawl portion 52*a* from drop-out from the fitting hole 51*a*.

Accordingly, the abutment of the joining end 45 of the second cover half 42 on the joining end 45 of the first cover half 41 having been installed on the frame structure 32 involves respective fittings of the first fitting portions 51 and the respective second fitting portions 52 with each other. The first cover half 41 and the second cover half 42 are thus coupled to each other through the first and second fitting portions 51, 52. All of the first and second fitting portions 51, 52, located inside the box cover 40, cannot impair aesthetic quality of appearance of the box cover 40.

In front and rear ends of the cutout 46 of the half-upper-wall front portion 40*c* in the first cover half 41, formed arc respective first fastening seat portions 54; meanwhile, in front and rear ends of the cutout 46 of the half upper-wall front portion 40*c* in the second cover half 42, formed are respective second fastening seat portions 55 so as to be superimposable on the first fastening seat portions 54. The first fastening seat portions 54 and the second fastening seat portions 55 are capable of being overlapped with each other to thereby form respective screwed holes penetrating through the first and second fastening seat portions 54, 55.

The operation lever 20 includes: a grip portion 21; a bellows-shaped cover member 22 covering a base end of the grip portion 21; and an attachment frame 23 covered with the cover member 22. As shown in FIG. 4, the operation lever 20 is installed on the box cover 40 by coupling the grip portion 20 and the pilot valve 31 to each other through the coupling opening and screwing respective screws 24 rotatably provided to the attaching frame 23 into the threaded holes. The installation of the operation lever 20 enhance the rigidity of the fixing of the half-upper-wall front portion 40*c* in the second cover half 42

The frame structure 32 further includes a support portion for supporting the second cover half 42 at the inner side thereof. The support portion 60 enables wobbling of the half-upper-wall rear portion 40*d* of the second cover half 42 to be suppressed. The half-upper-wall rear portion 40*d*, supported by the first cover half 41 only at two positions where the respective second fitting portions 52 exist, can be wobbled by a force exerted thereon. In particular, the region between the second fitting portions 52, 52 adjacent to each other is likely to be wobbled. The support portion 60 can suppress such wobble.

The support portion 60 is formed by utilization of the support flange 38 included in the frame structure 32. The support flange 38 is located, in the left console box 12L, so as to be opposed to a part between the second fitting portions 52, 52 adjacent to each other in the half-upper-wall rear portion 40*d* of the second cover half 42. Specifically, a portion of the support flange 38, the portion extending from a left edge to a rear edge thereof, protrudes up to a position close to the inner surface of the sidewall portion 40*a* and an inner surface of the half-upper-wall rear portion 40*d* in the second cover half 42, the portion forming a support body of the support portion 60. More specifically, there is mounted an elastic member 61 such as rubber or a synthetic resin on an edge of the support body, the support body and the elastic member 61 constituting the support portion 60.

Figure 6:
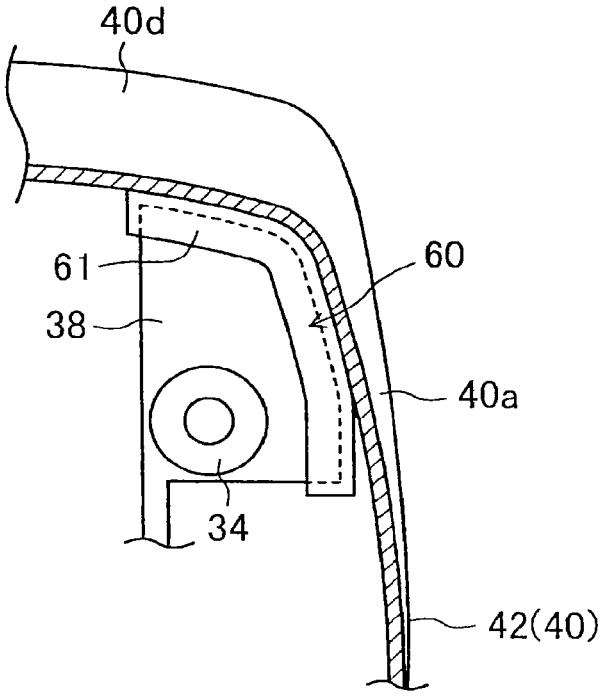
FIG. 6 is a sectional view showing an enlarged part corresponding to a support portion in the left console box.

As shown in FIG. 6, the support portion 60 makes contact with a corner section between the inner surface of the sidewall portion 40*a* of the second cover half 42, namely, a first surface of the second cover half 42 oriented in an abutment direction in which the first and second cover halves 41, 42 abut on each other, and the inner surface of the half-upper-wall rear portion 40*d*, namely, a second surface of the second cover half 42 oriented in a direction approximately perpendicular to the abutment direction. This corner section is located between the two second fitting portions 52 adjacent to each other in an upper and rear left portion of the second cover half 42, and the support portion 60 is kept in approximately line contact with the corner section through the elastic member 61. The elastic member 61 is capable of stable contact with the above inner surfaces even under some dimensional errors or assembling errors in the support portion 60 and others. In addition, the elastic member 61 has a frictional resistance enough to suppress displacement of a part in contact with the elastic member 61 relatively to the elastic member 61.

As above, the second cover half 42 is supported not only by the first cover half 41 through the first and second fitting portions 51, 52 fitted with each other, but also by the box body 30 through the support portion 60. This allows the wobble of the second cover half 42 to be suppressed. Specifically, the support portion 60 can receive a force exerted on the sidewall portion 40*a* from the outside thereof, by supporting the sidewall portion 40*a* of the second cover half 42 at the inner side thereof, thereby suppressing the wobble of the sidewall portion 40*a*. In addition, respective wobbles of the two second fitting portions 52 adjacent to each other and the first fitting portions 51 can also be suppressed, which allows the fitting thereof to be stabilized, thus making the suppression of the wobbles more effective.

The support portion 60 also can receive a force exerted on the half-upper-wall rear portion 40*d* from the outside thereof, by supporting the half-upper-wall rear portion 40*d* of the second cover half 42 at the inner side thereof, thereby suppress the wobble. Particularly, the support portion 60, simultaneously supporting the two sides defining the inner corner section of the second cover half 42, can suppress respective wobbles of both of the two sides, and further structurally reinforces the second cover half 42 by functioning as a beam between the frame structure 32 and the second cover half 42.

The working machine according to the present invention is not limited to the above embodiment, but is permitted to encompass, for example, the following embodiments.

While, in the above embodiment, the present invention is applied to the left console box 12L to which an external force is likely to be applied during the upturn operation, the present invention may be applied to the right console box 12R.

Figure 7:
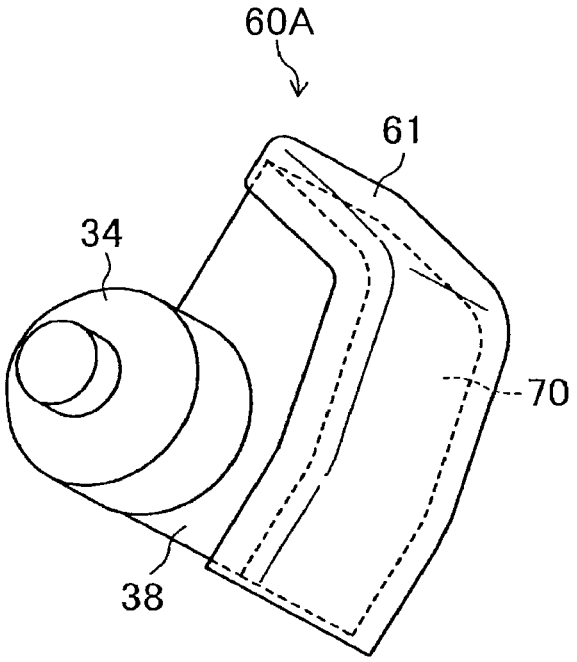
FIG. 7 is a schematic perspective view showing a first example of modification of the support portion.

While the support portion 60 according to the above embodiment is configured to make line contact with the inner surface of the second cover half 42, the support portion according to the present invention may make surface contact with the inner surface of the second cover half. One example thereof is shown in FIG. 7. There is shown a support portion 60A, which has a surface contact section 70 continuously joined to an edge of a support flange 38 and spreading along the inner surface of the second cover half 42, wherein the surface contact section 70 makes contact with the inner surface of the second cover half 42 through an elastic member 61.

Figure 8:
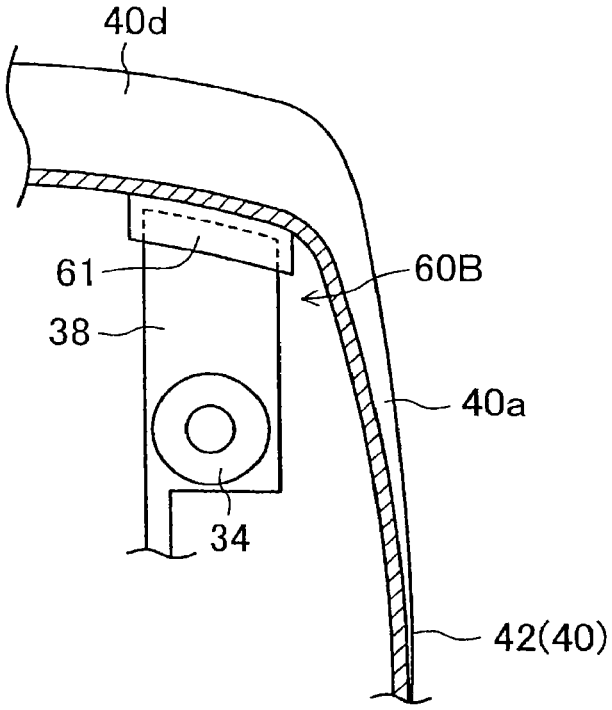
FIG. 8 is a sectional view showing a second example of the modification of the support portion.
Figure 9:
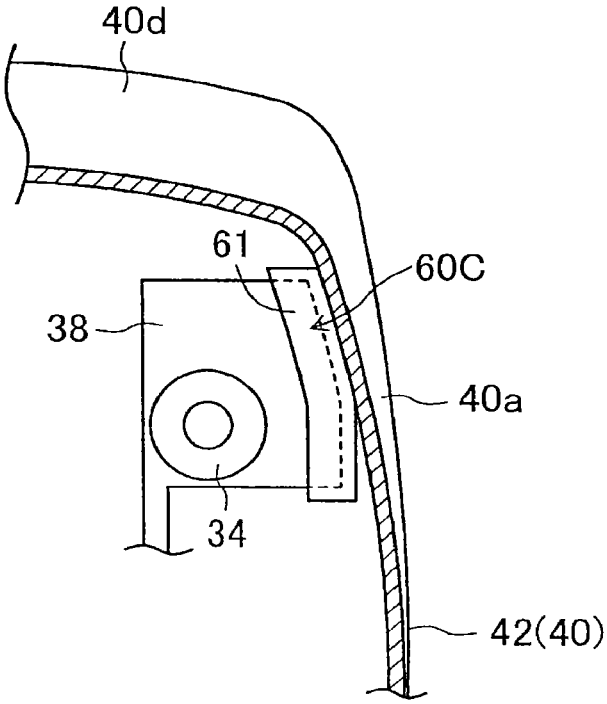
FIG. 9 is a sectional view showing a third example of the modification of the support portion.

Alternatively, the support portion of the present invention may be configured to support only the half-upper-wall rear portion 40*d* of the second cover half 42 at the inner side thereof, like a support portion 60B shown in FIG. 8, or may be configured to support only the sidewall portion 40*a* of the second cover half 42 at the inner side thereof, like a support portion 60C shown in FIG. 9.

The support portion according to the present invention is not limited to one provided by utilization of the support flange 38; it may be provided separately from the support flange 38. Besides, there may be provided a plurality of support portions in respective different positions. The specific position of the support portion also may be appropriately varied.

A male-female relationship between the first and second fitting portions in the present invention may be reverse to that in the first and second fitting portions 51, 52 in the above embodiment. Alternatively, the male type and the female type may be mixed in each of respective groups of first and second fitting portions.

As mentioned above, according to the present invention, provided is a working machine including a console box prevented from wobble without excessive increase in the number of fitting regions while possessing a fine appearance. The provided working machine comprises: a machine body including an operator's seat; and a console box disposed at a side of the operator's seat. The console box includes a box body supported by the machine body, and a box cover covering the box body while being supported by the box body. The box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to abut on the first cover half involving respective fittings of the first and second fitting portions with each other to be thereby coupled to the first cover half. The box body includes a support portion which makes contact with an inner surface of the second cover half to thereby support the second cover half in cooperation with the first and second fitting portions.

In this working machine, the second cover half constituting the box cover, supported by both of the first cover half and the box body, can be restrained from wobble. Specifically, the first and second cover halves abut on each other and further intercoupled by respective interfittings of the first fitting portions and the second fitting portions provided inside the first and second cover halves, respectively. The first cover half, installed on the box body, is securely supported, while the second cover half is supported not only by the first cover half through the first and second fitting portions but also by the box body because of the contact of the support portion with the second cover half. In addition, the first and second fitting portions and the support portion are located inside the box cover, thus prevented from impairing aesthetic quality of appearance of the box body.

The support portion may make contact, for example, with a first surface which is included in the inner surface of the second cover half and oriented in an abutment direction along which the first and second cover halves abut on each other, or with a second surface which is included in the inner surface of the second cover half in a second region and oriented in a direction approximately perpendicular to an abutment direction along which the first and second cover halves abut on each other. The support portion is, preferably, configured to make contact with both of the first and second surfaces.

The support portion, in the case of supporting the inner surface of the second cover half in the abutment direction, can receive a force exerted on the second cover half from the outside thereof in the abutment direction to thereby suppress the wobbling. Furthermore, the support portion can suppress respective wobbles of the first and second fitting portions to stabilize respective fittings thereof, thereby effectively suppressing the wobbling. On the other hand, the support portion, in the case of supporting the inner surface of the second cover half in a direction approximately perpendicular to the abutment direction, can receive a force exerted on the second cover half from the outside thereof in the direction, thereby suppressing the wobbles. Furthermore, in the case of supporting both of the first and second surfaces, the support portion can suppress respective wobbles the first and second surfaces and further structurally reinforce the second cover half.

The support portion, preferably, includes an elastic member to make contact with the inner surface of the second cover half. The elastic member can make stable contact with the inner surface even under some dimensional errors in the support portion and the second cover half. In addition, the elastic member can suppress displacement of the second cover half relatively to the elastic member by the frictional resistance of the elastic member itself.

The plurality of first fitting portions may be spaced along an edge of a joining end of the first cover half. In this case, it is preferable that the support portion is configured to make contact with a region between the second fitting portions adjacent to each other, in the inner surface of the second cover half. This allows respective regions of the second cover half supported by the first and second fitting portions and a region of the second cover half supported by the support portion to be efficiently distributed, thus allowing the wobbles to be effectively suppressed.

This application is based on Japanese Patent application No. 2013-224465 filed in Japan Patent Office on Oct. 29, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A working machine comprising:

a machine body including an operator's seat; and a console box disposed at a side of the operator's seat, the console box including an operation lever, a box body supported by the machine body and a box cover covering the box body while being supported by the box body, wherein the box body includes: a pilot valve which controls a hydraulic pressure according to manipulation applied to the operation lever, a frame structure having a rear end and a front end on which the pilot valve is mounted, and a bracket which rotationally movably supports the rear end of the frame structure;

the box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to be coupled to the first cover half by abutting the first cover half so as to involve respective fittings of the first and second fitting portions with each other; and the frame structure includes a support portion which makes contact with an inner surface of the second cover half to thereby support the second cover half in cooperation with the first and second fitting portions.

2. A working machine comprising:

a machine body including an operator's seat; and a console box disposed at a side of the operator's seat, the console box including a box body supported by the machine body and a box cover covering the box body while being supported by the box body, wherein the box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to be coupled to the first cover half by abutting the first cover half so as to involve respective fittings of the first and second fitting portions with each other; and the box body includes a support portion which makes contact with an inner surface of the second cover half to thereby support the second cover half in cooperation with the first and second fitting portions, wherein the support portion is configured to make contact with a surface which is included in the inner surface of the second cover half and oriented in an abutment direction along which the first and second cover halves abut each other.

3. The working machine as defined in claim 1, wherein the support portion is configured to make contact with a surface which is included in the inner surface of the second cover half and oriented in a direction approximately perpendicular to an abutment direction along which the first and second cover halves abut each other.

4. A working machine comprising:

a machine body including an operator's seat; and a console box disposed at a side of the operator's seat, the console box including a box body supported by the machine body and a box cover covering the box body while being supported by the box body, wherein the box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to be coupled to the first cover half by abutting the first cover half so as to involve respective fittings of the first and second fitting portions with each other;

the box body includes a support portion which makes contact with an inner surface of the second cover half to thereby support the second cover half in cooperation with the first and second fitting portions; and the support portion is configured to make contact with a first surface and a second surface which are included in the inner surface of the second cover half, the first surface being oriented in an abutment direction along which the first and second cover halves abut each other, the second surface being oriented in a direction approximately perpendicular to the abutment direction.

5. A working machine comprising:

a machine body including an operator's seat; and a console box disposed at a side of the operator's seat, the console box including a box body supported by the machine body and a box cover covering the box body while being supported by the box body, wherein the box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to be coupled to the first cover half by abutting the first cover half so as to involve respective fittings of the first and second fitting portions with each other;

the box body includes a support portion which makes contact with an inner surface of the second cover half to thereby support the second cover half in cooperation with the first and second fitting portions; and the support portion includes an elastic member to make contact with the inner surface of the second cover half.

6. A working machine comprising:

a machine body including an operator's seat and a console box disposed at a side of the operator's seat, the console box including a box body supported by the machine body and a box cover covering the box body while being supported by the box body, wherein the box cover includes: a first cover half installed on the box body, the first cover half including a plurality of first fitting portions inside the first cover half; and a second cover half including a plurality of second fitting portions, inside the second cover half, to be fitted with the first fitting portions, respectively, the second cover half configured to be coupled to the first cover half by abutting the first cover half so as to involve respective fittings of the first and second fitting portions with each other;

the box body includes a support portion which makes contact with an inner surface of the second cover half to thereby support the second cover half in cooperation with the first and second fitting portions; and the plurality of first fitting portions are spaced along an edge of a joining end of the first cover half, and the support portion is configured to make contact with a region of the inner surface of the second cover half, the region being located between two of the second fitting portions, the two of the second fitting portions being adjacent to each other.

* * * * *